US011167880B2

(12) United States Patent
Peterges et al.

(10) Patent No.: US 11,167,880 B2
(45) Date of Patent: Nov. 9, 2021

(54) POURING ELEMENT FOR A PACKAGE AND COMPOSITE PACKAGE HAVING SUCH A POURING ELEMENT

(71) Applicant: SIG Technology AG, Neuhausen am Rheinfall (CH)

(72) Inventors: Olivier Peterges, Eupen (BE); Martin Ruegg, Uhwiesen (CH); Thomas Vetten, Dusseldorf (DE); Sven Himmelsbach, Stein am Rhein (CH); Hansjörg Huber, Radolfzell (DE)

(73) Assignee: SIG Technology AG, Neuhausen am Rheinfall (CH)

( * ) Notice: Subject to any disclaimer, the term of this patent is extended or adjusted under 35 U.S.C. 154(b) by 0 days.

(21) Appl. No.: 15/740,885

(22) PCT Filed: Jun. 9, 2016

(86) PCT No.: PCT/EP2016/063111

§ 371 (c)(1),
(2) Date: Dec. 29, 2017

(87) PCT Pub. No.: WO2017/001161

PCT Pub. Date: Jan. 5, 2017

(65) Prior Publication Data

US 2018/0186505 A1 Jul. 5, 2018

(30) Foreign Application Priority Data

Jun. 30, 2015 (DE) ..... 10 2015 110 526.8
Jun. 30, 2015 (EP) ..... 15020106

(51) Int. Cl.
*B65D 5/74* (2006.01)
*B65D 55/02* (2006.01)

(52) U.S. Cl.
CPC ..... *B65D 5/747* (2013.01); *B65D 5/746* (2013.01); *B65D 55/024* (2013.01)

(58) Field of Classification Search
CPC ..... B65D 5/746; B65D 47/122; B65D 2547/063; B65D 11/04; B65D 5/747;
(Continued)

(56) References Cited

U.S. PATENT DOCUMENTS 3,235,111 A * 2/1966 Whitton, Jr. ..... B01L 3/508 215/321
3,690,524 A * 9/1972 Haberhauer ..... B29C 65/18 222/573

(Continued)

FOREIGN PATENT DOCUMENTS

DE 102005048821 A1 4/2007
DE 102010050502 A1 5/2012

(Continued)

*Primary Examiner* — Vishal Pancholi
*Assistant Examiner* — Bob Zadeh
(74) *Attorney, Agent, or Firm* — The Webb Law Firm

(57) ABSTRACT

A pouring element for a package having a base body, a polyhedrally formed flange, the flange inner surfaces of which converge in face abutments, for joining to a package sleeve and at least one holding element projecting on the inside of the flange for operatively connecting to a mandrel of a packaging machine, as well as a pouring element with polyhedrally formed gable surfaces, which are correspondingly joined to the polyhedrally formed flange. Provision is made for the holding element to be formed as a rounding in the area of the face abutments on the inside of the flange, in order to prevent the pouring element from becoming damaged during the whole joining process with the package sleeve when putting the pouring element onto, holding it on and removing it from the mandrel and additionally in order to guarantee a secure and precise hold.

18 Claims, 6 Drawing Sheets

(58) Field of Classification Search
CPC ..... B65D 55/024; B65D 2251/0015; B65D 2251/0093; B65D 5/748; B65D 51/222; B43K 11/00; B43K 11/005; B43K 8/003; B43K 8/02; B43K 8/026; B43K 8/03; B43K 8/04; B43K 8/06; H03G 3/00
See application file for complete search history.

(56) References Cited

U.S. PATENT DOCUMENTS 4,003,506 A * 1/1977 Fuchs ..... A47G 19/24 222/555
4,471,882 A 9/1984 Joo
4,877,142 A * 10/1989 Doering ..... B65D 1/0223 215/382
6,129,228 A * 10/2000 Adams ..... B65D 5/746 215/45
6,402,019 B1 * 6/2002 Casale ..... B65B 61/186 220/258.1
7,597,244 B2 * 10/2009 Boldrini ..... B65D 15/22 229/110
8,770,423 B2 * 7/2014 McGeough ..... B65D 43/162 220/212
9,238,531 B2 * 1/2016 Himmelsbach ..... B65D 5/748
2005/0127118 A1 * 6/2005 Boldrini ..... B65D 5/746 222/556
2005/0247744 A1 * 11/2005 Nottingham ..... B44D 3/12 222/568
2006/0157501 A1 7/2006 Jackson et al.
2013/0256336 A1 * 10/2013 Himmelsbach ..... B65D 5/748 222/81
2013/0305659 A1 * 11/2013 Kenn ..... B65B 3/027 53/426
2014/0374953 A1 * 12/2014 Middleton ..... B29C 45/14336 264/275
2015/0259109 A1 * 9/2015 Vetten ..... B65D 5/748 222/548
2018/0186505 A1 * 7/2018 Peterges ..... B65D 5/747
2018/0194512 A1 * 7/2018 Huber ..... B65D 5/746
2018/0265240 A1 * 9/2018 Palmer ..... B65D 1/023

FOREIGN PATENT DOCUMENTS

DE 102012020529 A1 4/2014
EP 1487705 B1 5/2007
EP 1503940 B1 9/2009
JP 2004155453 A 6/2004
JP 2009039980 A * 2/2009 ..... B29C 66/53247
WO 0214169 A1 2/2002
WO 03086880 A1 10/2003
WO 2009075849 A1 6/2009
WO 2012048935 A1 4/2012
WO 2012062565 A1 5/2012
WO 2014060133 A1 4/2014
WO WO 2014060133 A1 * 4/2014 ..... B65D 5/748

* cited by examiner

POURING ELEMENT FOR A PACKAGE AND COMPOSITE PACKAGE HAVING SUCH A POURING ELEMENT

CROSS-REFERENCE TO RELATED APPLICATIONS

This application is the United States national phase of International Application No. PCT/EP2016/063111 filed Jun. 9, 2016, and claims priority to German Patent Application No. 10 2015 110 526.8 and European Patent Application No. 15020106.9, each filed Jun. 30, 2015, the disclosures of which are hereby incorporated in their entirety by reference.

BACKGROUND OF THE INVENTION

Field of the Invention

The invention relates to a pouring element for a package, in particular a composite package for liquid foods, having a base body, a polyhedrally formed flange, the flange inner surfaces of which converge in face abutments, for joining to a package sleeve and at least one holding element projecting on the inside of the flange for operatively connecting to a mandrel of a packaging machine, as well as to a composite package for liquid foods with polyhedrally formed gable surfaces.

Description of Related Art

In packaging technology, composite packaging has been part of the established prior art for a long time. Thus, for example, beverage cartons consist of different packaging materials, such as paper and plastic materials, which when joined and pressed together over their full surfaces form a packing laminate. The layer composition can vary according to requirements and so, for example, for aseptic filling goods an aluminium layer is additionally inserted, in order to obtain a good barrier effect against gases and light. Often—but not always—the laminate is even cut to packaging size during its production and in this way so-called package sleeves are formed. Alternatively, the packing laminate is often also supplied as a rolled product and only cut to size later.

The actual shaping and filling of the package and closing it to form a package takes place in a packaging machine which is frequently also called a form-fill-seal-machine referring to its main functions. Liquid foods, such as beverages, soups, yoghurt or suchlike, predominantly qualify as filling goods.

Such packages are sometimes also provided with pouring elements. In addition to controlled pouring, these pouring elements usually also enable the consumer to reclose the package. Frequently and predominantly with aseptic use, a first opening function is also provided for the package. Here, the previously gas-tight sealed package is opened for the first time. This can be effected, for example, by means of a pull ring or tab or by means of a piercing and/or cutting device. Such piercing and/or cutting devices are often designed as cutting rings which are linked to the screw cap, for example, via drive means, so that by twisting the screw cap the package is at the same time cut open.

WO 2012/048935 A1 originating from the applicant demonstrates a pouring element of the type mentioned, for example. This pouring element essentially consists of a base body which is sealed by means of a screw cap and in addition to the actual pouring neck also has a flange for joining to the rest of the package parts (here a package sleeve). The pouring elements are incorporated into the package when the package is being formed and before actual filling takes place and in this way form a part of the package. Depending on the package shape and type, the pouring element is applied from the inside through a pre-cut hole in the flat gable of the package. The flange of the pouring element then extends parallel to the plane of the flat gable of the package, as is disclosed in the first exemplary embodiment shown there. However, it is also possible for the pouring element itself to form the top area of the package, as shown in the further illustrated exemplary embodiment. The joining flange projects angled from the actual pouring element and forms a polyhedrally formed flange which here essentially corresponds to a truncated pyramid.

The pouring element is usually incorporated and joined to the package in a packaging machine which has already been mentioned at the beginning. Such a packaging machine is disclosed in WO 2012/062565 A1 originating from the applicant. There, FIG. 5 in the left area shows a mandrel wheel with nine working mandrels (in short: mandrels) arranged over its circumference. The filling plant, which is of no further interest here, is arranged in the right section. The mandrel wheel rotates cyclically in operation, so that the mandrels rotate between individual working positions (I to IX) and remain in these positions for the production steps to be carried out, in order to join the pouring element to the sleeve and to basically form the top area of the package. In working position I, the pouring element is brought onto the still empty mandrel by means of a feed device. Afterwards, the mandrel wheel rotates, in order to bring the mandrel fed with the pouring element into working position II, in which a package sleeve is slid onto the mandrel. In working positions III and IV, the pouring element and the package sleeve receive a thermal hot-air activation in the areas of the subsequent joining places, i.e. the plastic material is locally fused. The activated surfaces are then pressed together in working position V, so that a firm and durable join is obtained. The subsequent working positions VI and VII apply the projecting package sleeve sections (the so-called "ears"), which are formed by producing the truncated pyramid shaped package gable, onto the gable sections. At position VIII, the package completed on one side in the gable area is then passed on to a cell chain of the filling plant, where it is filled through the bottom area which is still open, and after that it is sealed and the bottom area is completed. No production step is allocated to position IX.

The pouring element is subjected to considerable thermal and mechanical loads when it is being joined to the package sleeve. It must for the time being remain locked securely held and in the required position via the individual working positions of the mandrel wheel, then released again together with the package sleeve. During the hot-air activation, the material in the area of the flange is firstly locally fused, so that it can be pressed with the package sleeve in the subsequent step. In addition to holding, the production steps produce additional mechanical and thermal loads for the pouring element.

Alternatively, there are also, for example, ultrasonic joining techniques of the established prior art. The high-frequency vibrations and static joining forces also induce further considerable loads for the pouring element.

Various solutions have been proposed for the temporary connection between the pouring element and the mandrel in the past. Vacuum-working solutions, such as those as shown in WO 9739958 A1, are technically complex and give rise to high investment and operating costs for the packaging machine. Mechanical holders are technically simpler and cheaper to implement, but involve an additional mechanical load for the pouring element due to the form-fit and/or frictionally-engaged connection.

JP 2009039980 A discloses a frictionally-engaged connection between the pouring element and the mandrel. The applicant carried out an investigation regarding engagement and separation forces as a function of different holding mandrel designs (essentially their geometry). The test results from the series of tests (including damaged pouring elements) are shown in the reproduced table.

Form-fit connections between the pouring element and the mandrel define the final position of the pourer on the mandrel with regard to all degrees of freedom. Such a solution is disclosed in WO 2014060133 A1 originating from the applicant. A circumferential holding element on the flange of the pourer with a mandrel corresponding to it guarantee a reliable connection and simple removal. In the exemplary embodiment shown there, the holding element is formed as a projection.

A pouring element has not always withstood the various loads to which it has been subjected when it is being produced in the packaging machine. In a not insignificant number of cases, failing pouring elements have resulted in damaged and/or leaking packages. The damage ranges from broken or torn flanges to defective joining areas. The pouring elements and/or packages also often only fail when they are being stacked during their subsequent distribution.

SUMMARY OF THE INVENTION

Therefore, it is the object of the present invention to develop and enhance a pouring element and a composite package of the type mentioned at the beginning and previously described in more detail in such a way that the disadvantages described are overcome. In particular, damage to the pouring element and the composite package should be prevented and at the same time a secure hold between the pouring element and the mandrel should be guaranteed.

This object is achieved with a pouring element as described herein, by the fact that the holding element is formed as a rounding in the area of the face abutments on the inside of the flange. A round geometry of the holding element principally permits smoother mechanical operations than rectangular ones. In this way, the pouring element can be put onto and removed from the mandrel effortlessly. Furthermore, the rounding of the holding element in the "corner areas" guarantees a secure and precise hold on the mandrel during all production steps. The joining steps can therefore be carried out with a high precision. In addition, the roundings cause the holding element to be more tolerant in terms of structural mechanics with respect to unwanted stress concentrations and therefore it has a higher strength. As a result, thermally or mechanically caused stresses in the pouring element are thus largely prevented, so that the structure is not weakened or at all damaged.

The object forming the basis of the invention is also achieved by a composite package for liquid foods with polyhedrally formed gable surfaces, in which these gable surfaces are correspondingly joined to the polyhedrally formed flange of such a pouring element.

A further teaching of the invention makes provision for the holding element to be circumferentially formed. The height of the holding element can be reduced with the holding force remaining the same through the increased contact area of the operative connection between the holding element and the mandrel. In this way, the holding element can be pushed onto and detached from the mandrel more smoothly. In addition, a holding element which is reduced in height has a higher strength.

According to a further embodiment of the invention, the holding element runs in the area of the bottom edge of the flange. The lower the holding element is arranged on the polyhedrally formed flange, the longer the area is in which the flange can elastically deform when it is put on and removed. Elastic deformability is, however, absolutely desired, so that no defective plastic deformation occurs.

In a further advantageous embodiment, the operative connection between the holding element and the mandrel is carried out in a form-fit manner. Consequently, the pouring element is fixed in its final position with regard to all degrees of freedom. In this way, higher precision can be achieved during the work processes, so that the risk of damaged pouring elements or packages is greatly reduced.

However, within the scope of the invention, alternatively the operative connection between the holding element and the mandrel can be carried out in a frictionally-engaged manner.

Frictionally-engaged operative connections can, depending on the specific design of the pouring element, always be preferable if "snapping" of the pouring element in the mandrel is not desired.

According to a further teaching of the invention, the face abutments on the inside of the flange are formed as fillets. Sharp transitions between surfaces are unfavourable in terms of structural mechanics, so that the negative rounded grooves give the pouring element a higher strength and, in addition, crack growth is prevented.

A further advantageous embodiment of the invention makes provision for reinforcement ribs to be formed over the face abutments on the inside of the flange. These structural elements provide the pouring element with additional strength particularly in the critical "corner areas" of the flange.

Another teaching of the invention makes provision for the flange of the base body to be in the shape of a truncated pyramid. A particularly uniform distribution of the forces between the pouring element and the package sleeve can hereby be achieved.

A further embodiment of the invention makes provision for the base body to have a rectangular base plate and in particular the base plate can be square. In this way, an improved course of the strain lines in the base body can be obtained without causing damage to the pouring element.

A further type of embodiment according to the invention makes provision for the transitions between the base plate and the flange to be formed as fillets. The hollowed surface transitions are consequently stronger in the face of stresses and minimise the risk of damage.

According to a further advantageous embodiment, the corners formed by the face abutments on the inside of the flange and the base plate are shaped as spherical roundings.

These "sensitive" corner areas are in this way additionally strengthened and allow a progression of forces which does not result in damage between the adjoining planes.

A further teaching of the invention makes provision for the base body to have a pouring neck, wherein this pouring neck is initially sealed with a screw cap. This is a particularly advantageous alternative for the pouring element.

According to a further embodiment of the invention, the base body is closed below the pouring neck by means of a retaining wall and has a circumferential weakening zone.

Such a retaining wall additionally strengthens the pouring element, particularly in the area of the base plate and the pouring neck.

Further advantageous embodiments make provision for a barrier film to abut on the retaining wall, optionally also, for a handle to be integrally formed on the retaining wall, so that it can be removed by manually pulling on the handle, or for a cutting element to be arranged in the pouring neck, so that the retaining wall can at least partly be cut open in the area of the weakening zone. These are particularly advantageous alternatives for the pouring element.

BRIEF DESCRIPTION OF THE DRAWINGS

The invention is explained in more detail below with the aid of the figures illustrating one exemplary embodiment.

DESCRIPTION OF THE INVENTION

Figure 1:
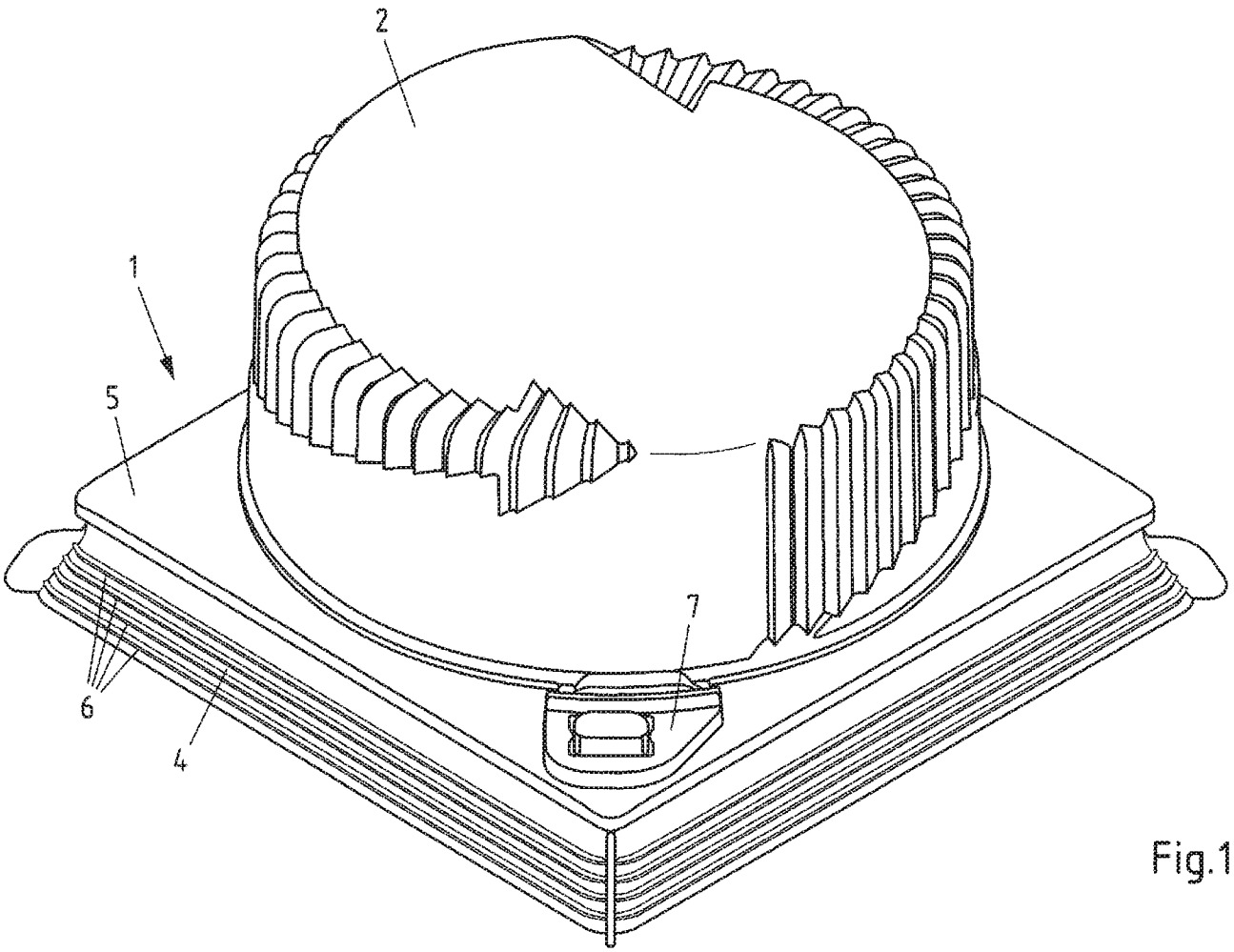
FIG. 1 shows a pouring element according to the invention in a perspective view from above.

FIG. 1 shows a preferred exemplary embodiment of a pouring element according to the invention in a perspective illustration at an angle from above. The pouring element in the illustrated and in this respect preferred exemplary embodiment has a base body 1 and a screw cap 2. The screw cap 2 fits on a pouring neck 3 (easily identifiable in FIGS. 2 and 3) which forms a part of the base body 1.

The base body 1 has a polyhedrally formed—more precisely truncated pyramid shaped—flange 4. The flange 4 and the pouring neck 3 project in opposing directions from a square base plate 5 and together form the actual base body 1. The shape of the polyhedrally formed flange 4 is adapted to the shape and in particular to the angle of inclination of the gable area 32 of a package sleeve 30. The gable area 32 of the package P is therefore at least in the area adjoining the flange 4 likewise in the shape of a truncated pyramid.

The angled outer surfaces of the flange 4 have outer ribs 6 which, on the one hand, mechanically reinforce the flange 4 and, on the other hand, enable the gable surfaces of the package sleeve 30 to be bound better to the flange 4 during sealing. In each corner area, a wing-like projection is integrally formed on the flange 4. The projections also serve to improve the join between the gable area 32 of the package sleeve 30 and the flange 4 of the pouring element.

In the case of the pouring element illustrated in FIG. 1, a tamper-evident safety seal 7 with material bridges (not specified in more detail) formed as predetermined break points connects the base body 1 to the screw cap 2. When the package is opened for the first time, the material bridges are destroyed, so that a consumer can easily identify whether a package provided with this pouring element has already been opened before.

Figure 2:
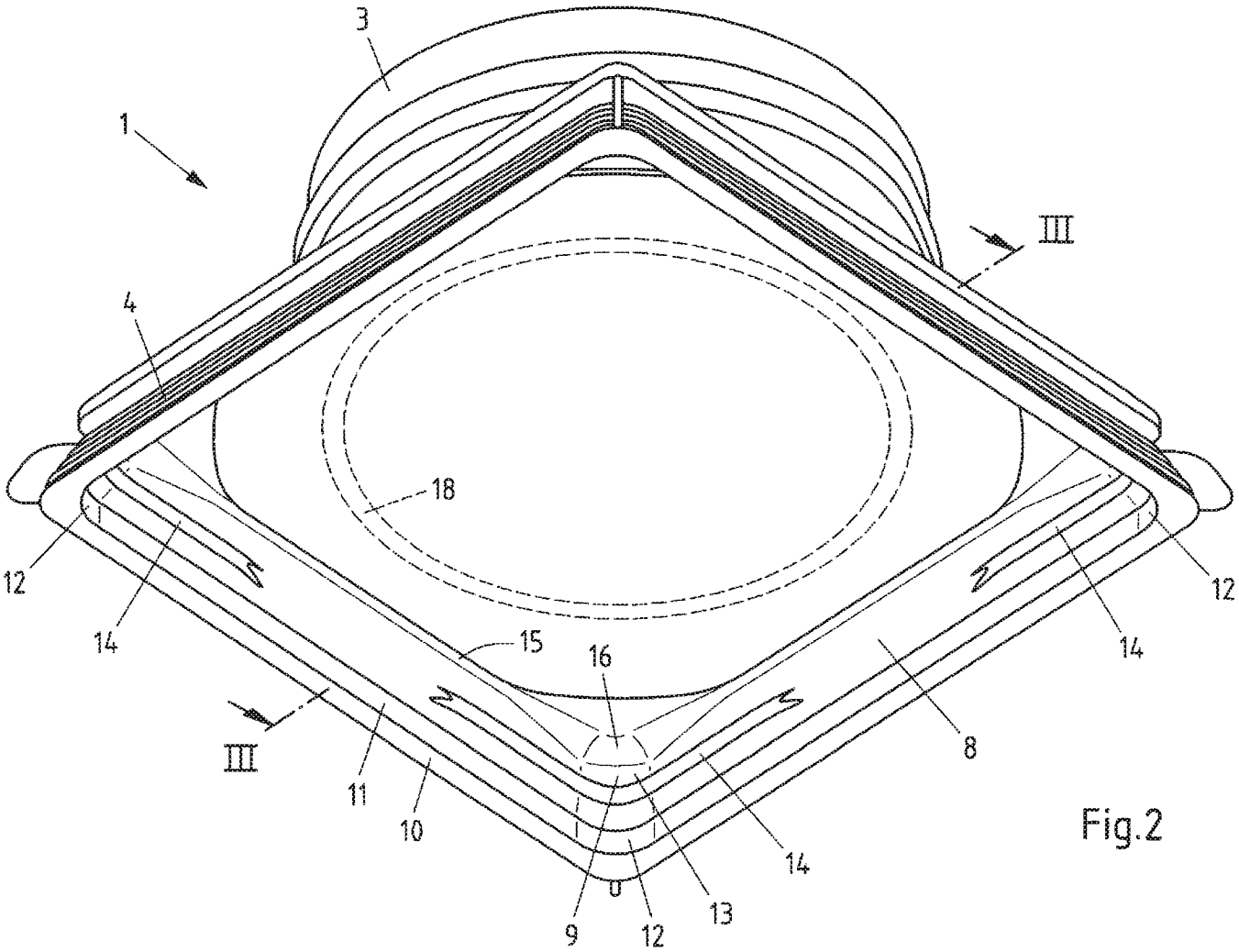
FIG. 2 shows the pouring element from FIG. 1 in a perspective view from below without the screw cap

FIG. 2 shows the pouring element according to the invention in a perspective illustration at an angle from below. The polyhedrally formed flange 4 has corresponding flange inner surfaces 8 on its inside, which form face abutments 9 in the area in which they converge. The flange 4 ends in a bottom edge 10. A projecting, circumferential holding element 11 runs in the area of this bottom edge 10 and extends continuously over all flange inner surfaces 8. The holding element 11 creates a mechanical connection with a free coupling end 31 of a mandrel 33 of a packaging machine (not illustrated) when the package top and the gable area 32 are being formed. The holding element 11 is formed as a rounding 12 in the area of the face abutments 9 on the inside of the flange, so that it can be put onto and detached from the mandrel smoothly. The pouring element remains precisely and securely held during all the production steps.

In the illustrated and in this respect preferred exemplary embodiment, the face abutments 9 are also formed as fillets 13. Reinforcement ribs 14 are also integrally formed in the area of the face abutments 9 on the inside of the flange and additionally increase the strength in the corner areas. As shown in FIG. 2, the holding element 11 defines a substantially rectangular aperture with four rounded corners in an area of the corners on the inside of the flange 4 to assist in smoothly attaching and detaching the pouring element from the mandrel. The areas of the surface transitions between the flange inner surfaces 8 of the flange 4 and the inner surface of the base plate 5 are also formed as negative rounded grooves, i.e. as fillets 15. The corners formed between the face abutments 9 on the inside of the flange and the base plate 5 are formed as spherical roundings 16.

Figure 3:
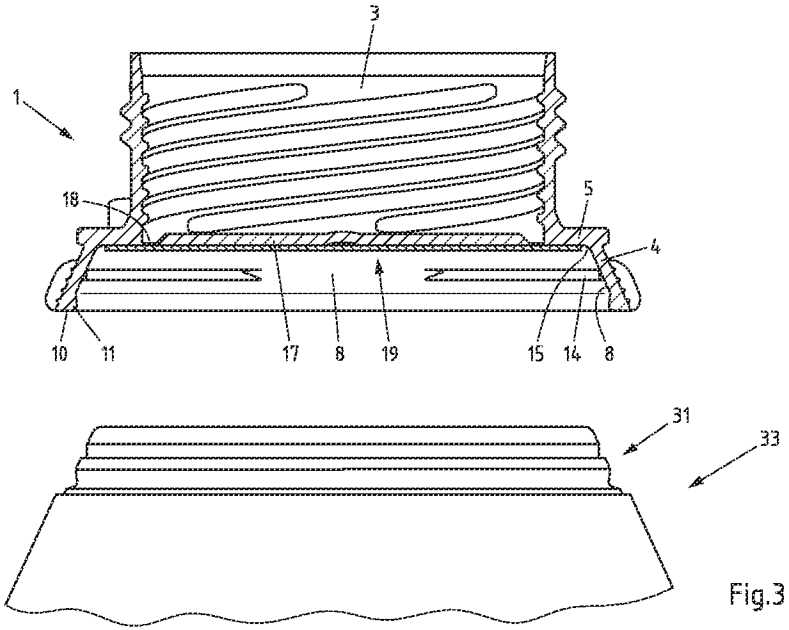
FIG. 3 shows the pouring element in vertical cross section along the line III-III from FIG. 2.
Figure 4:
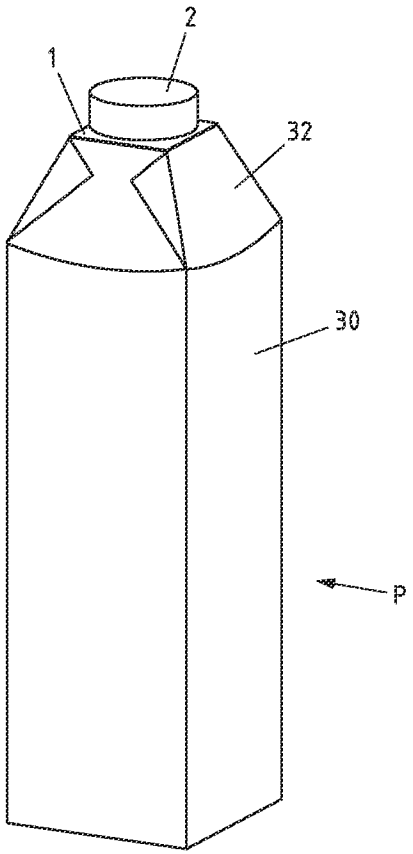
FIG. 4 is a perspective view of a package according to one example of the present disclosure.
Figure 5:
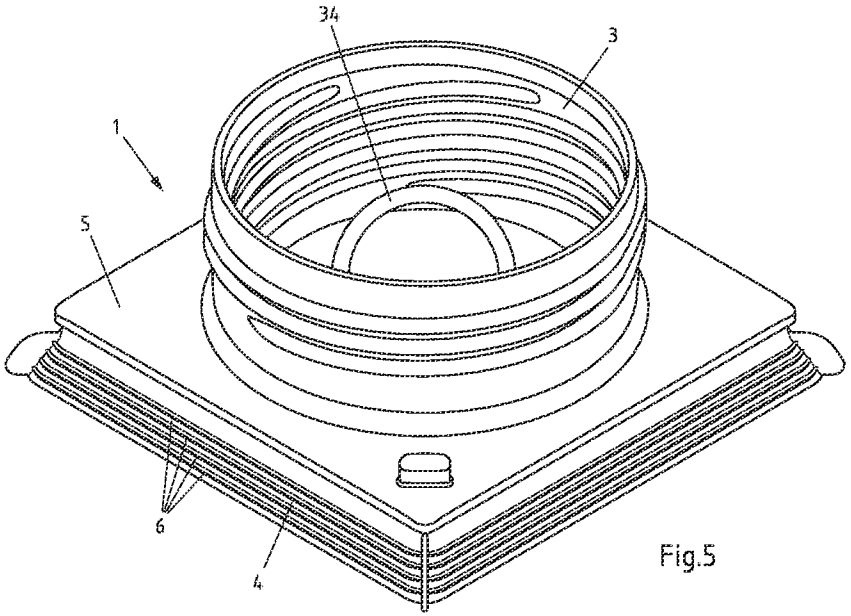
FIG. 5 is a perspective view of the pouring element of FIG. 1 with a handle.
Figure 6:
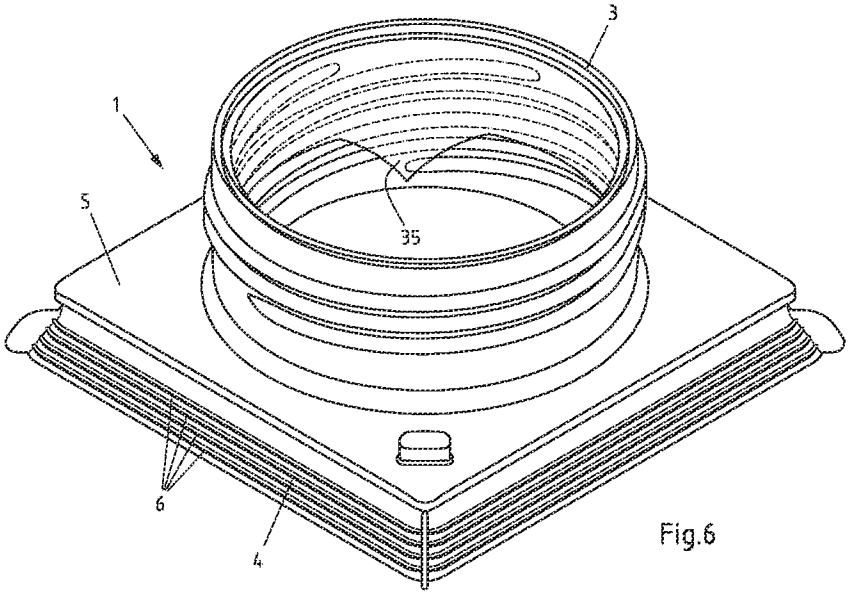
FIG. 6 is a perspective view of the pouring element of FIG. 1 with a cutting element.

It can also be identified in the vertically cut illustration of FIG. 3 that the underside of the pouring neck 3 in its original state is sealed by a retaining wall 17. This is joined to the base body 1 via a weakening zone 18. In order to guarantee a sufficient shelf life and preserve the flavor of the filled product, a barrier film 19 is applied on the inside of the base plate 5 and the retaining wall 17. FIG. 4 shows a perspective view of a package according to one example of the present disclosure. It is also contemplated that a handle 34 may be included in the pouring element as shown in FIG. 5. FIG. 6 shows a cutting element 35 that cuts through the weakening zone 18 when the screw cap 2 is unscrewed for the first time and in this way exposes the opening of the pouring neck 3 for pouring.

The invention claimed is:

1. A pouring element for a package comprising a base body, a polyhedrally formed flange, inner surfaces of which converge in face abutments at four separate corners, for joining to a package sleeve and at least one holding element projecting on an inside of the flange for operatively connecting to a mandrel of a packaging machine, wherein the holding element defines a substantially rectangular aperture with four rounded corners in an area of the corners on the inside of the flange to assist in smoothly attaching and detaching the pouring element from the mandrel, and wherein the at least one holding element are protrusions, each of which extend from the inner surface of the flange of the pouring element.

2. The pouring element according to claim 1, wherein the holding element is circumferentially formed.

3. The pouring element according to claim 1, wherein the holding element runs in an area of a bottom edge of the flange.

4. The pouring element according to claim 1, wherein an operative connection between the holding element and the mandrel is carried out in a form-fit manner.

5. The pouring element according to claim 1, wherein the operative connection between the holding element and the mandrel is carried out in a frictionally-engaged manner.

6. The pouring element according to claim 1, wherein the face abutments on the inside of the flange are formed as fillets.

7. The pouring element according to claim 1, wherein the flange of the base body is in a shape of a truncated pyramid.

8. The pouring element according to claim 1, wherein the base body has a rectangular base plate.

9. The pouring element according to claim 8, wherein the base plate is square.

10. The pouring element according to claim 8, wherein transitions between the base plate and the flange are formed as fillets.

11. The pouring element according to claim 8, wherein corners formed by the face abutments on the inside of the flange and the base plate are shaped as spherical rounding s.

12. The pouring element according to claim 1, wherein the base body has a pouring neck.

13. The pouring element according to claim 12, wherein the pouring neck is sealed with a screw cap.

14. The pouring element according to claim 12, wherein the base body is closed below the pouring neck by means of a retaining wall and has a circumferential weakening zone.

15. The pouring element according to claim 14, wherein a barrier film abuts on the retaining wall.

16. The pouring element according to claim 14, wherein a handle is integrally formed on the retaining wall, so that the retaining wall can be removed by manually pulling on the handle.

17. The pouring element according to claim 14, wherein a cutting element is arranged in the pouring neck, so that the retaining wall can at least partly be cut open in an area of the weakening zone.

18. The pouring element according to claim 1, wherein the pouring element is made for a composite package for liquid foods with polyhedrally formed gable surfaces, wherein the gable surfaces are correspondingly joined to the polyhedrally formed flange.

* * * * *